US006455482B1

(12) United States Patent
D'Ambrogio et al.

(10) Patent No.: US 6,455,482 B1
(45) Date of Patent: Sep. 24, 2002

(54) LIGHT DUTY LIQUID CLEANING COMPOSITIONS COMPRISING A CROSSLINKED POLYMER

(75) Inventors: Robert D'Ambrogio, Bound Brook; Mahmoud Hassan, Somerset; Nagaraj Dixit, Plainsboro, all of NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/005,796

(22) Filed: Nov. 8, 2001

(51) Int. Cl.[7] ..... C11D 12/00

(52) U.S. Cl. ..... 510/218; 510/235; 510/421; 510/424; 510/428; 510/475; 510/476; 510/503

(58) Field of Search ..... 510/218, 235, 510/421, 424, 428, 475, 476, 503

(56) References Cited

U.S. PATENT DOCUMENTS 6,150,313 A * 11/2000 Harmalker et al. ..... 510/130
6,383,995 B1 * 5/2002 Maurin et al. ..... 510/119

* cited by examiner

*Primary Examiner*—Necholus Ogden
(74) *Attorney, Agent, or Firm*—Richard E. Nanfeldt

(57) ABSTRACT

A light duty liquid detergent with desirable cleansing properties and mildness to the human skin comprising: at least one surfactant, a solubilizing system and a crosslinked polymer and water.

3 Claims, No Drawings

LIGHT DUTY LIQUID CLEANING COMPOSITIONS COMPRISING A CROSSLINKED POLYMER

FIELD OF THE INVENTION

This invention relates to a light duty liquid cleaning composition having enhanced viscosity and which imparts enhanced mildness to the skin and improved foam properties and is also designed in particular for effective removal of grease soil from the dishware and for leaving the rinsed surfaces of the dishware with a shiny appearance.

BACKGROUND OF THE INVENTION

The present invention relates to novel light duty liquid detergent compositions with enhanced viscosity and improved high foaming properties, containing at least one olefin sulfonate surfactant, an ammonium or alkali metal salt of an ethoxylated alkyl ether sulfate surfactant, a paraffin sulfonate, a complex of a crosslinked polymer formed from an alkyl vinyl ether/maleic anhydride copolymer and a polyol compound, and, optionally, an amine oxide, and water.

The prior art is replete with light duty liquid detergent compositions containing nonionic surfactants in combination with anionic and/or betaine surfactants wherein the nonionic detergent is not the major active surfactant, as shown in U.S. Pat. No. 3,658,985 wherein an anionic based shampoo contains a minor amount of a fatty acid alkanolamide. U.S. Pat. No. 3,769,398 discloses a betaine-based shampoo containing minor amounts of nonionic surfactants. This patent states that the low foaming properties of nonionic detergents renders its use in shampoo compositions non-preferred. U.S. Pat. No. 4,329,335 also discloses a shampoo containing a betaine surfactant as the major ingredient and minor amounts of a nonionic surfactant and of a fatty acid mono- or di-ethanolamide. U.S. Pat. No. 4,259,204 discloses a shampoo comprising 0.8–20% by weight of an anionic phosphoric acid ester and one additional surfactant which may be either anionic, amphoteric, or nonionic. U.S. Pat. No. 4,329,334 discloses an anionic-amphoteric based shampoo containing a major amount of anionic surfactant and lesser amounts of a betaine and nonionic surfactants.

U.S. Pat. No. 3,935,129 discloses a liquid cleaning composition based on the alkali metal silicate content and containing five basic ingredients, namely, urea, glycerin, triethanolamine, an anionic detergent and a nonionic detergent. The silicate content determines the amount of anionic and/or nonionic detergent in the liquid cleaning composition. However, the foaming property of these detergent compositions is not discussed therein.

U.S. Pat. No. 4,129,515 discloses a heavy duty liquid detergent for laundering fabrics comprising a mixture of substantially equal amounts of anionic and nonionic surfactants, alkanolamines and magnesium salts, and, optionally, zwitterionic surfactants as suds modifiers.

U.S. Pat. No. 4,224,195 discloses an aqueous detergent composition for laundering socks or stockings comprising a specific group of nonionic detergents, namely, an ethylene oxide of a secondary alcohol, a specific group of anionic detergents, namely, a sulfuric ester salt of an ethylene oxide adduct of a secondary alcohol, and an amphoteric surfactant which may be a betaine, wherein either the anionic or nonionic surfactant may be the major ingredient.

The prior art also discloses detergent compositions containing all nonionic surfactants as shown in U.S. Pat. Nos. 4,154,706 and 4,329,336 wherein the shampoo compositions contain a plurality of particular nonionic surfactants in order to effect desirable foaming and detersive properties despite the fact that nonionic surfactants are usually deficient in such properties.

U.S. Pat. No. 4,013,787 discloses a piperazine based polymer in conditioning and shampoo compositions which may contain all nonionic surfactant or all anionic surfactant.

U.S. Pat. No. 4,671,895 teaches a liquid detergent composition containing an alcohol sulfate surfactant, a nonionic surfactant, a paraffin sulfonate surfactant, an alkyl ether sulfate surfactant and water.

U.S. Pat. No. 4,450,091 discloses high viscosity shampoo compositions containing a blend of an amphoteric betaine surfactant, a polyoxybutylene polyoxyethylene nonionic detergent, an anionic surfactant, a fatty acid alkanolamide and a polyoxyalkylene glycol fatty ester. But, none of the exemplified compositions contains an active ingredient mixture wherein the nonionic detergent is present in major proportion, probably due to the low foaming properties of the polyoxybutylene polyoxyethylene nonionic detergent.

U.S. Pat. No. 4,595,526 describes a composition comprising a nonionic surfactant, a betaine surfactant, an anionic surfactant and a $C_{12}$–$C_{14}$ fatty acid monoethanolamide foam stabilizer.

U.S. Pat. Nos. 4,675,422; 4,698,181; 4,724,174; 4,770,815 and 4,921,942 disclose alkyl succinamates but the compositions are non related to light duty liquid compositions.

However, none of the above-cited patents discloses a liquid detergent composition containing at least one olefin sulfonate surfactant, an alkali metal or ammonium salt of an ethoxylated alkyl ether sulfate surfactant, a paraffin sulfonate surfactant and a complex of an alkyl vinyl ether/maleic anhydride copolymer with a polyol compound and optionally, an amine oxide surfactant, betaine surfactant, an alkyl monoalkanol amide and/or an ethoxylated alkyl monoalkanol amide, and water, wherein the composition does not contain any low molecular weight mono- or di-glucoside, abrasives, silicas, alkaline earth metal carbonates, alkyl glycine surfactant, cyclic imidinium surfactant, alkali metal carbonates or more than 3 wt. % of a fatty acid or its salt thereof.

SUMMARY OF THE INVENTION

It has now been found that a light duty liquid composition can be made which has desirable cleaning properties together with enhanced viscosity and improved high foaming properties.

An object of this invention is to provide a novel light duty liquid detergent composition containing at least 3 to 24 wt. % one olefin sulfonate surfactant, at least one 3 to 30 wt. % of second surfactant selected from the group consisting of linear alkyl benzene sulfonates, paraffin sulfonates, ethoxylated alkyl ether sulfates, alkyl mono alkanol amides and amine oxides and mixtures thereof, 2% to 15% of a crosslinked polymer which is formed from crosslinked reaction product of a polyol compound and an alkyl vinyl ether/maleic anhydride copolymer, 0.1% to 15% of a solubilizing system and water wherein the composition does not contain any silicas, abrasives, alkali metal carbonates, alkaline earth metal carbonates, alkyl glycine surfactant, cyclic imidinium surfactant, low molecular weight mono- or di-glucoside organoaluminum containing compounds, organo titanium containing compounds, triethylene tetramine hexaacetic acid, imidazolenes, or more than 3 wt. % of a fatty acid or salt thereof.

Another object of this invention is to provide a novel light duty liquid detergent with desirable high foaming and cleaning properties which is very mild to the human skin.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

The light duty liquid compositions of the instant invention comprise approximately by weight:

(a) 2.0% to 12%, more preferably 3% to 10% of a crosslinked polymer which comprises the crosslinked reaction product of an alkyl vinyl ether/maleic anhydride copolymer with a polyol compound, wherein the weight ratio of the alkyl vinyl ether/maleic anhydride copolymer to the polyol compound is about 1:4 to about 4:1;

(b) 6% to 15% of an alkali metal salt of an alpha olefin sulfonate surfactant;

(c) 3% to 9% of an alkali metal salt of a paraffin sulfonate surfactant;

(d) 6% to 15% of an ammonium or alkali metal salt of an ethoxylated alkyl ether sulfate surfactant;

(e) 3% to 9% of an alkali metal salt of a linear alkyl benzene sulfonate;

(f) 0 to 3%, more preferably 0.5% to 2.5% of a $C_{12}$–$C_{14}$ alkyl mono alkanol amide;

(g) 0.5% to 15%, more preferably 1% to 10% of a solubilizing system such as a mixture of a $C_2$–$C_3$ alkanol and an alkali metal halide; and (h) the balance being water, wherein the composition has a pH of 5 to 8.

The instant invention also relates to an acidic light duty liquid compositions which comprise approximately by weight:

(a) 4.0% to 10%, more preferably 5% to 9% of a crosslinked polymer which comprises the crosslinked reaction product of an alkyl vinyl ether/maleic anhydride copolymer with a polyol compound, wherein the weight ratio of the alkyl vinyl ether/maleic anhydride copolymer to the polyol compound is about 1:4 to about 4:1;

(b) 15% to 25% of an alkali metal salt of an alpha olefin sulfonate surfactant;

(c) 5% to 15% of an alkali metal salt of a paraffin sulfonate surfactant;

(d) 3% to 12% of an amine oxide surfactant;

(e) 0.01% to 2.0% of a proton donating agent;

(f) 0.5% to 1 5%, more preferably 1% to 10% of a solubilizing system;

(g) 0 to 5%, more preferably 0.25% to 3% of an alkylene glycol such as hexylene glycol; and (h) the balance being water.

The alpha olefin sulfonates used in the instant compositions include long-chain alkene sulfonates, long-chain hydroxyalkane sulfonates or mixtures of alkene sulfonates and hydroxyalkane sulfonates. These alpha olefin sulfonate surfactants may be prepared in a known manner by the reaction of sulfur trioxide ($SO_3$) with long-chain olefins containing 8 to 25, preferably 12 to 21 carbon atoms and having the formula $RCH{=}CHR_1$ where R is a higher alkyl group of 6 to 23 carbons and $R_1$ is an alkyl group of 1 to 17 carbons or hydrogen to form a mixture of sultones and alkene sulfonic acids which is then treated to convert the sultones to sulfonates. Preferred alpha olefin sulfonates contain from 14 to 16 carbon atoms in the R alkyl group and are obtained by sulfonating an a-olefin.

The $C_{8\text{-}18}$ ethoxylated alkyl ether sulfate surfactants used in the instant composition have the structure:

$$R{-}(OCHCH_2)_nOSO_3^-M^+$$

wherein n is about 1 to about 22 more preferably 1 to 3 and R is an alkyl group having about 8 to about 18 carbon atoms, more preferably 12 to 15 and natural cuts, for example, $C_{12\text{-}14}$; $C_{12\text{-}15}$ and M is an ammonium cation or an alkali metal cation, most preferably sodium or ammonium.

The ethoxylated alkyl ether sulfate may be made by sulfating the condensation product of ethylene oxide and $C_{8\text{-}10}$ alkanol, and neutralizing the resultant product. The ethoxylated alkyl ether sulfates differ from one another in the number of carbon atoms in the alcohols and in the number of moles of ethylene oxide reacted with one mole of such alcohol. Preferred ethoxylated alkyl ether polyethenoxy sulfates contain 12 to 15 carbon atoms in the alcohols and in the alkyl groups thereof, e.g., sodium myristyl (3 EO) sulfate.

Ethoxylated $C_{8\text{-}18}$ alkylphenyl ether sulfates containing from 2 to 6 moles of ethylene oxide in the molecule are also suitable for use in the invention compositions. These detergents can be prepared by reacting an alkyl phenol with 2 to 6 moles of ethylene oxide and sulfating and neutralizing the resultant ethoxylated alkylphenol.

The instant composition can contain at least one sulfonate surfactant which is a magnesium and/or sodium salt of a linear $C_8$–$C_{16}$ alkyl benzene sulfonate such as a magnesium or sodium salt of a linear dodecyl benzene sulfonate or a $C_{13}$–$C_{17}$ paraffin surfactant which is an alkali metal salt or magnesium salt of a $C_{13}$–$C_{17}$ sulfonate such as the sodium salt of $C_{13}$–$C_{17}$ paraffin sulfonate.

The linear alkyl benzene sulfonates can contain from 10 to 16 carbon atoms in the alkyl group are used in the instant compositions wherein the alkyl benzene sulfonate has a high content of 3- (or higher) phenyl isomers and a correspondingly low content (well below 50%) of 2- (or lower) phenyl isomers, that is, wherein the benzene ring is preferably attached in large part at the 3 or higher (for example, 4, 5, 6 or 7) position of the alkyl group.

The crosslinked polymer of the present invention is a gel product of a maleic anhydride copolymer with a $C_1$–$C_4$ alkyl vinyl ether, preferably methyl or ethyl vinyl ether which is crosslinked with a polyol compound such as an alkyl polysaccharide surfactant.

The alkyl vinyl ether/maleic anhydride copolymer used to prepare the gel product of the present invention contains the alkyl vinyl ether and maleic anhydride monomers at a weight ratio of about 1:4 to about 4:1, and is preferably a methyl vinyl ether/maleic anhydride (MVE/MA) copolymer having a molecular weight (M.W.) of from about 30,000 to about 1,000,000. These copolymers are commercially available under the Gantrez trademark.

The AVE/MA copolymers are crosslinked by the process of the present invention creating a linearly viscoelastic material. The copolymers are lightly crosslinked so that they swell and form gels, having strong three-dimensional networks in aqueous systems.

In accordance with the process of the present invention, the polyol crosslinking is performed subsequent to the formation of the AVE/MA copolymer. The crosslinking reaction is carried out in an aqueous medium in accordance with a reaction mechanism which is believed to be a condensation polymerization. A suitable polyol crosslinking agent is an alkyl polyglucoside.

Water employed in the preparation of crosslinked copolymer compositions is preferably deionized and free of organic impurities. Water generally comprises from about 60 to 95 percent of the reaction medium in which the crosslinked polymer is prepared. These amounts of water include the free water which is added, plus that which is introduced with other materials, as for example, water entrained in the polyol.

The crosslinking reaction is preferably carried out in the presence of a relatively small quantity of a base catalyst. The presence of such a base enhances and accelerates the rate of the crosslinking reaction. Either an organic or inorganic base can be present, at a concentration of about 0.1 to about 2% by weight based on the copolymer and preferably about 0.25 to about 1% by weight. Typical organic bases are, for example, monoethanolamine, diethanolamine, and triethanolamine (TEA). Typical inorganic bases are alkali hydroxides, as for example, sodium hydroxide and potassium hydroxide. Sodium hydroxide is a preferred base catalyst.

In accordance with the preferred embodiment of this invention the process of the present invention is carried out in the presence of a base catalyst, and an alkyl polysaccharide surfactant is used as the crosslinking agent, the polyol is present in the aqueous reaction medium at a weight ratio of at least about 40:1 in relationship to the quantity of the AVE/MA copolymer and preferably from about 50:1. In the absence of a base catalyst, the much longer reaction time which is required to effect crosslinking fosters the hydrolysis of the AVE/MA copolymer, and significantly reduces the quantity of anhydride available for reaction with the polyol. In such a case, in the absence of a base catalyst in the reaction medium, the initial weight ratio of polyol to anhydride must be of the order of 5:1 to allow for an adequate, available nonhydrolyzed quantity of anhydride to be present to facilitate sufficient crosslinking to form the desired viscoelastic gel product.

In the preparation of the crosslinked copolymer, the AVE/MA copolymer and polyol crosslinking agent are added to water in a suitable vessel. In the preferred embodiment, i.e., in the presence of an alkali catalyst, a polyol water mixture is first preheated to between about 50° and about 90° C., preferably from about 550 to 75° C. to the polyol/water mixture the AVE/MA copolymer is slowly added under agitation and mixed for abut 3 to about 5 minutes. The alkali catalyst is then added to the polyol/water and AVE/MA copolymer mixture. The quantity of catalyst required to accelerate the crosslinking reaction should be such as to maintain the pH of the reaction medium at about 6 to about 8.5. Higher pH levels are to be avoided as the crosslinked product undergoes a phase shift transition from a gel to a sol. The addition of the AVE/MA copolymer to the water/alkali catalyst mixture is performed under constant agitation using a conventional agitation means, such as mechanical stirrer, or vibrator; the agitation is maintained until the completion of the reaction, generally a period of from about 4 to about 10 minutes after the addition of the AVE/MA is complete.

The polyol used in forming the crosslinked polymer is a polysaccharide surfactants which have a hydrophobic group containing from about 8 to about 20 carbon atoms, preferably from about 10 to about 16 carbon atoms, most preferably from about 12 to about 14 carbon atoms, and polysaccharide hydrophilic group containing from about 1.5 to about 10, preferably from about 1.5 to about 4, most preferably from about 1.6 to about 2.7 saccharide units (e.g., galactoside, glucoside, fructoside, glucosyl, fructosyl; and/or galactosyl units). Mixtures of saccharide moieties may be used in the alkyl polysaccharide surfactants. The number x indicates the number of saccharide units in a particular alkyl polysaccharide surfactant. For a particular alkyl polysaccharide molecule x can only assume integral values. In any physical sample of alkyl polysaccharide surfactants there will be in general molecules having different x values. The physical sample can be characterized by the average value of x and this average value can assume non-integral values. In this specification the values of x are to be understood to be average values. The hydrophobic group (R) can be attached at the 2-, 3-, or 4- positions rather than at the 1-position, (thus giving e.g. a glucosyl or galactosyl as opposed to a glucoside or galactoside). However, attachment through the 1- position, i.e., glucosides, galactoside, fructosides, etc., is preferred. In the preferred product the additional saccharide units are predominately attached to the previous saccharide unit's 2-position. Attachment through the 3-, 4-, and 6-positions can also occur. Optionally and less desirably there can be a polyalkoxide chain joining the hydrophobic moiety (R) and the polysaccharide chain. The preferred alkoxide moiety is ethoxide.

Typical hydrophobic groups include alkyl groups, either saturated or unsaturated, branched or unbranched containing from about 8 to about 20, preferably from about 10 to about 18 carbon atoms. Preferably, the alkyl group is a straight chain saturated alkyl group. The alkyl group can contain up to 3 hydroxy groups and/or the polyalkoxide chain can contain up to about 30, preferably less than about 10, alkoxide moieties.

Suitable alkyl polysaccharides are decyl, dodecyl, tetradecyl, pentadecyl, hexadecyl, and octadecyl, di-, tri-, tetra-, penta-, and hexaglucosides, galactosides, lactosides, fructosides, fructosyls, lactosyls, glucosyls and/or galactosyls and mixtures thereof.

The alkyl monosaccharides are relatively less soluble in water than the higher alkyl polysaccharides. When used in admixture with alkyl polysaccharides, the alkyl monosaccharides are solubilized to some extent. The use of alkyl monosaccharides in admixture with alkyl polysaccharides is a preferred mode of carrying out the invention. Suitable mixtures include coconut alkyl, di-, tri-, tetra-, and pentaglucosides and tallow alkyl tetra-, penta-, and hexaglucosides.

The preferred alkyl polysaccharides are alkyl polyglucosides having the formula $$RO(C_nH_{2n}O)_r(Z)_x$$

wherein Z is derived from glucose, R is a hydrophobic group selected from the group consisting of alkyl, alkylphenyl, hydroxyalkylphenyl, and mixtures thereof in which said alkyl groups contain from about 10 to about 18, preferably from about 12 to about 14 carbon atoms; n is 2 or 3 preferably 2, r is from 0 to 10, preferably 0; and x is from 1.5 to 8, preferably from 1.5 to 4, most preferably from 1.6 to 2.7. To prepare these compounds a long chain alcohol ($R_2OH$) can be reacted with glucose, in the presence of an acid catalyst to form the desired glucoside. Alternatively the alkyl polyglucosides can be prepared by a two step procedure in which a short chain alcohol ($R_1OH$) can be reacted with glucose, in the presence of an acid catalyst to form the desired glucoside. Alternatively the alkyl polyglucosides can be prepared by a two step procedure in which a short chain alcohol ($C_{1-6}$) is reacted with glucose or a polyglucoside (x=2 to 4) to yield a short chain alkyl glucoside (x=1 to 4) which can in turn be reacted with a longer chain alcohol ($R_2OH$) to displace the short chain alcohol and obtain the desired alkyl polyglucoside. If this two step procedure is used, the short chain alkylglucoside content of the final alkyl polyglucoside material should be less than 50%, preferably less than 10%, more preferably less than about 5%, most preferably 0% of the alkyl polyglucoside.

The amount of unreacted alcohol (the free fatty alcohol content) in the desired alkyl polysaccharide surfactant is preferably less than about 2%, more preferably less than about 0.5% by weight of the total of the alkyl polysaccharide. For some uses it is desirable to have the alkyl monosaccharide content less than about 10%.

The used herein, "alkyl polysaccharide surfactant" is intended to represent both the preferred glucose and galactose derived surfactants and the less preferred alkyl polysaccharide surfactants. Throughout this specification, "alkyl polyglucoside" is used to include alkyl polyglycosides because the stereochemistry of the saccharide moiety is changed during the preparation reaction.

An especially preferred APG glycoside surfactant is Glucopon 625 glycoside manufactured by the Henkel Corporation of Ambler, Pa. Glucopon 625 is a nonionic alkyl polyglycoside characterized by the formula:

$$C_nH_{2n+1}O(C_6H_{10}O_5)_xH$$

wherein n=10 (2%); n=12 (65%); n=14 (21–28%); n=16 (4–8%) and n=18 (0.5%) and x (degree of polymerization)= 1.6. Glucopon 625 has: a pH of 6 to 10 (10% of Glucopon 625 in distilled water); a specific gravity at 25° C. of 1.1 g/mI; a density at 25° C. of 9.1 lbs/gallon; a calculated HLB of 12.1 and a Brookfield viscosity at 35° C., 21 spindle, 5–10 RPM of 3,000 to 7,000 cps.

Amine oxide semi-polar nonionic surfactants which can be used in the instant composition comprise compounds and mixtures of compounds having the formula:

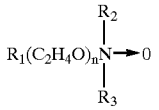

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

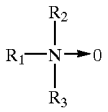

wherein $R_1$ is a $C_{12-16}$ alkyl, or cocoamidopropyl group and $R_2$ and $R_3$ are methyl or ethyl. The above ethylene oxide condensates, amides, and amine oxides are more fully described in U.S. Pat. No. 4,316,824 which is hereby incorporated herein by reference. Preferred amine oxides are lauryl amine oxide and cocoamido propyl amine oxide.

The instant compositions can also contain about 0 wt. % to about 3 wt. %, more preferably about 0.5 wt. % to about 2.5 wt. % of a $C_{12}$–$C_{14}$ alkyl monoalkanol amide such as lauryl monoalkanol amide (LMMEA). The instant compositions can contain about 0 to about 2 wt. %, more preferably about 0.25 to about 1.75 wt. % of an ethoxylated $C_{12}$–$C_{14}$ alkyl monoalkanol amide containing 1 to 6 ethoxylated groups such as PEG-6 lauramide and preferably the alkanol portion is ethanol.

The instant compositions contain about 0.5 wt. % to about 15 wt. %, more preferably about 1 wt. % to about 10 wt. %, of at least one solubilizing agent which can be selected from the group consisting of an alkali metal halide such as sodium chloride, an alkaline earth metal halide such as magnesium chloride, sodium xylene sulfonate, sodium cumene sulfonate, a $C_{2-3}$ mono or dihydroxy alkanols such as ethanol, isopropanol and propylene glycol and mixtures thereof. The solubilizing agents are included in order to control low temperature cloud clear properties. Urea can be optionally employed in the instant composition as a supplemental solubilizing agent at a concentration of 0 to about 10 wt. %, more preferably about 0.5 wt. % to about 8 wt. %.

Other solubilizing agents, optionally used at a concentration of up to 15 wt. % are glycerol, water-soluble polyethylene glycols having a molecular weight of 300 to 600, polypropylene glycol of the formula $HO(CH_3CHCH_2O)_nH$ wherein n is a number from 2 to 18, mixtures of polyethylene glycol and polypropylene glycol (Synalox) and mono $C_1$–$C_6$ alkyl ethers and esters of ethylene glycol and propylene glycol having the structural formulas $R(X)_nOH$ and $R_1(X)_nOH$ wherein R is $C_1$–$C_6$ alkyl group, $R_1$ is $C_2$–$C_4$ acyl group, X is $(OCH_2CH_2)$ or $(OCH_2(CH_3)CH)$ and n is a number from 1 to 4.

Representative members of the polypropylene glycol include dipropylene glycol and polypropylene glycol having a molecular weight of 200 to 1000, e.g., polypropylene glycol 400. Other satisfactory glycol ethers are ethylene glycol monobutyl ether (butyl cellosolve), diethylene glycol monobutyl ether (butyl carbitol), triethylene glycol monobutyl ether, mono, di, tri propylene glycol monobutyl ether, tetraethylene glycol monobutyl ether, mono, di, tripropylene glycol monomethyl ether, propylene glycol monomethyl ether, ethylene glycol monohexyl ether, diethylene glycol monohexyl ether, propylene glycol tertiary butyl ether, ethylene glycol monoethyl ether, ethylene glycol monomethyl ether, ethylene glycol monopropyl ether, ethylene glycol monopentyl ether, diethylene glycol monomethyl ether, diethylene glycol monoethyl ether, diethylene glycol monopropyl ether, diethylene glycol monopentyl ether, triethylene glycol monomethyl ether, triethylene glycol monoethyl ether, triethylene glycol monopropyl ether, triethylene glycol monopentyl ether, triethylene glycol monohexyl ether, mono, di, tripropylene glycol monoethyl ether, mono, di tripropylene glycol monopropyl ether, mono, di, tripropylene glycol monopentyl ether, mono, di, tripropylene glycol monohexyl ether, mono, di, tributylene glycol mono methyl ether, mono, di, tributylene glycol monoethyl ether, mono, di, tributylene glycol monopropyl ether, mono, di, tributylene glycol monobutyl ether, mono, di, tributylene glycol monopentyl ether and mono, di, tributylene glycol monohexyl ether, ethylene glycol monoacetate and dipropylene glycol propionate.

In addition to the previously mentioned essential and optional constituents of the light duty liquid detergent, one may also employ normal and conventional adjuvants, provided they do not adversely affect the properties of the detergent. Thus, there may be used various coloring agents and perfumes; ultraviolet light absorbers such as the Uvinuls, which are products of GAF Corporation; sequestering agents such as ethylene diamine tetraacetates; magnesium sulfate heptahydridate; perfumed, preservatives, colorants, etc. The proportion of such adjuvant materials, in total will normally not exceed 15% by weight of the detergent composition, and the percentages of most of such individual components will be a maximum of 5% by weight and preferably less than 2% by weight. Sodium formate or formalin can be included in the formula as a preservative at a concentration of 0.1 to 4.0 wt. %. Sodium bisulfite can be used as a color stabilizer at a concentration of 0.01 to 0.2 wt. %. The proton donating agent is selected from the group consisting of $C_3$–$C_{10}$ aliphatic organic acid, alpha hydroxy aliphatic acids such as lactic acid or citric acid and inorganic acids such as sulfuric acid, hydrochloric acid, and phosphoric acid and mixtures thereof.

The instant formulas explicitly exclude alkali metal silicates and alkali metal builders such as alkali metal polyphosphates, alkali metal carbonates, alkali metal phosphonates and alkali metal citrates because these materials, if used in the instant composition, would cause the composition to have a high pH as well as leaving residue on the surface being cleaned. The final essential ingredient in the inventive compositions having improved interfacial tension properties is water.

In final form, the instant compositions exhibit stability at reduced and increased temperatures. More specifically, such compositions remain clear and stable in the range of 5° C. to 50° C., especially 10° C. to 43° C. Such compositions exhibit a pH of 3 to 8.

The following examples illustrate liquid cleaning compositions of the described invention. Unless otherwise specified, all percentages are by weight. The exemplified compositions are illustrative only and do not limit the scope of the invention. Unless otherwise specified, the proportions in the examples and elsewhere in the specification are by weight.

EXAMPLE 1

The following compositions in wt. % were prepared by simple mixing procedure at 25° C.:

| | A | B | C | D | E | F | G |
|---|---|---|---|---|---|---|---|
| Sodium alpha olefin sulfonate | 9.87 | 9.87 | 9.87 | 9.87 | 9.87 | 9.87 | 9.87 |
| Ammonium alkyl ether sulfate: 1.3E0 | 9.87 | 9.87 | 9.87 | 9.87 | 9.87 | 9.87 | 9.87 |
| Sodium paraffin sulfonate | 6.33 | 6.33 | 6.33 | 6.33 | 6.33 | 6.33 | 6.33 |
| Sodium linear alkyl sulfonate | 6.33 | 6.33 | 6.33 | 6.33 | 6.33 | 6.33 | 6.33 |
| Lauryl/myristal monoethanol amide | 2.50 | 2.50 | 2.50 | 2.50 | 2.50 | 2.50 | 2.50 |
| SD3A/alcohol (95% ETOH, 5% MEOH) | 6.40 | 6.40 | 6.40 | 6.40 | 6.40 | 6.40 | 6.40 |
| NaCl | 0.50 | 0.50 | 0.50 | 0.50 | 0.50 | 0.50 | 0.50 |
| Fragrance | 0.45 | 0.45 | 0.45 | 0.45 | 0.45 | 0.45 | 0.45 |
| HEDTA chelant | 0.08 | 0.08 | 0.08 | 0.08 | 0.08 | 0.08 | 0.08 |
| Dowicil 75 preservative | 0.04 | 0.04 | 0.04 | 0.04 | 0.04 | 0.04 | 0.04 |
| Green color | 0.001 | 0.001 | 0.001 | 0.001 | 0.001 | 0.001 | 0.001 |
| APG625 | 9.00 | 9.00 | | | 9.00 | | |
| LMW copolymer | | 0.18 | | | | | |
| APG625/LMW copolymer | | | 9.18 | 9.37 | | | |
| MMW copolymer | | | | | 0.18 | | |
| APG625/MMW copolymer | | | | | | 9.18 | 9.37 |
| Sulfuric acid | q.s. | q.s. | q.s. | q.s. | q.s. | q.s. | q.s. |
| Sodium hydroxide | q.s. | q.s. | q.s. | q.s. | q.s. | q.s. | q.s. |
| Deionized water | bal. | bal. | bal. | bal. | bal. | bal. | bal. |
| Foam Performance | | | | | | | |
| Foam volume without soil (ml) | 405 | 410 | 413 | 417 | 413 | 413 | 418 |
| Foam volume with soil (ml) | 199 | 207 | 208 | 220 | 207 | 210 | 222 |
| Foam longevity (grams soil added) | 4.31 | 4.76 | 4.85 | 5.34 | 4.58 | 4.55 | 5.16 |
| Rheology | | | | | | | |
| Formula viscosity (eps) | 495 | 520 | 590 | 675 | 545 | 625 | 730 |

EXAMPLE 2

The following compositions in wt. % were prepared by simple mixing procedure at 25° C.:

| | A | B | C | D | E | F | G |
|---|---|---|---|---|---|---|---|
| Sodium alpha olefin sulfonate | 20.87 | 20.87 | 20.87 | 20.87 | 20.87 | 20.87 | 20.87 |
| Sodium paraffin sulfonate | 10.43 | 10.43 | 10.43 | 10.43 | 10.43 | 10.43 | 10.43 |
| C12 Amidopropylamine oxide | 8.70 | 8.70 | 8.70 | 8.70 | 8.70 | 8.70 | 8.70 |
| SD3A/alcohol (95% ETOH, 5% MEOH) | 6.40 | 6.40 | 6.40 | 6.40 | 6.40 | 6.40 | 6.40 |
| MgCl2 | 0.55 | 0.55 | 0.55 | 0.55 | 0.55 | 0.55 | 0.55 |
| Hexylene glycol | 2.00 | 2.00 | 2.00 | 2.00 | 2.00 | 2.00 | 2.00 |
| Fragrance | 0.45 | 0.45 | 0.45 | 0.45 | 0.45 | 0.45 | 0.45 |
| Citric acid | 0.10 | 0.10 | 0.10 | 0.10 | 0.10 | 0.10 | 0.10 |
| Sodium bisulfite | 0.10 | 0.10 | 0.10 | 0.10 | 0.10 | 0.10 | 0.10 |
| Dowicil 75 preservative | 0.04 | 0.04 | 0.04 | 0.04 | 0.04 | 0.04 | 0.04 |
| Green color | 0.001 | 0.001 | 0.001 | 0.001 | 0.001 | 0.001 | 0.001 |
| APG625 | 6.00 | 6.00 | | | | | |
| LMW copolymer | | 0.12 | | | | | |
| APG625/LMW copolymer | | | 6.12 | 6.24 | | | |
| MMW copolymer | | | | | 0.12 | | |
| APG625/MMW copolymer | | | | | | 6.12 | 6.24 |
| Sulfuric acid | q.s. | q.s. | q.s. | q.s. | q.s. | q.s. | q.s. |
| Sodium hydroxide | q.s. | q.s. | q.s. | q.s. | q.s. | q.s. | q.s. |
| Deionized water | bal. | bal. | bal. | bal. | bal. | bal. | bal. |
| Foam Performance | | | | | | | |
| Foam volume without soil (ml) | 392 | 407 | 412 | 415 | 405 | 410 | 415 |
| Foam volume with soil (ml) | 218 | 228 | 233 | 240 | 225 | 233 | 238 |
| Foam longevity (grams soil added) | 5.55 | 5.91 | 6.15 | 6.51 | 6.20 | 6.33 | 6.54 |
| Rheology | | | | | | | |
| Formula viscosity (eps) | 530 | 585 | 638 | 700 | 612 | 688 | 793 |

What is claimed:

1. An acidic light duty clear liquid dishwashing composition which comprises approximately by weight:

(a) 15% to 25% of an alpha olefin sulfonate;

(b) 5% to 15% of a paraffin sulfonate surfactant;

(c) 3% to 12% of an amine oxide surfactant;

(d) 0.5% to 15% of a solubilizing agent;

(e) 0.01% to 2.0% of a proton donating agent;

(f) 2.0% to 12%, of a crosslinked polymer which comprises the crosslinked reaction product of an alkyl vinyl ether/maleic anhydride copolymer with a polyol compound, wherein the weight ratio of the alkyl vinyl ether/maleic anhydride copolymer to the polyol compound is about 1:4 to about 4:1; and (g) the balance being water, wherein the composition has a pH of 3 to 8 and does not contain any low molecular weight mono- or di-glucoside, abrasives, silicas, alkaline earth metal carbonates, alkyl glycine surfactant, cyclic imidinium surfactant, alkali metal carbonates or more than 3 wt. % of a fatty acid or its salt thereof.

2. The composition of claim 1 further including an alkylene glycol.

3. The composition of claim 1, wherein the solubilizing system is a mixture of a $C_2$–$C_3$ alkanol and an alkali metal halide or an alkaline earth metal halide.

* * * * *